US009872568B2

(12) United States Patent
Capra et al.

(10) Patent No.: US 9,872,568 B2
(45) Date of Patent: Jan. 23, 2018

(54) CLOSURE DEVICES FOR SEAT CUSHIONS

(71) Applicant: Boa Technology Inc., Denver, CO (US)

(72) Inventors: James Capra, Steamboat Springs, CO (US); Mark Dutton, Steamboat Springs, CO (US); Anna Hetman, Denver, CO (US); Steven D. DuFresne, Hartland, WI (US)

(73) Assignee: Boa Technology Inc., Denver, CO (US)

( * ) Notice: Subject to any disclaimer, the term of this patent is extended or adjusted under 35 U.S.C. 154(b) by 0 days.

(21) Appl. No.: 14/620,086

(22) Filed: Feb. 11, 2015

(65) Prior Publication Data

US 2015/0223608 A1 Aug. 13, 2015

Related U.S. Application Data

(60) Provisional application No. 61/938,618, filed on Feb. 11, 2014.

(51) Int. Cl.

| | |
|---|---|
| ***A47C 7/14*** | (2006.01) |
| ***A47C 7/22*** | (2006.01) |
| ***A47C 7/40*** | (2006.01) |
| ***B68G 5/00*** | (2006.01) |

(52) U.S. Cl.

CPC ..... *A47C 7/22* (2013.01); *A47C 7/40* (2013.01); *B68G 5/00* (2013.01); *Y10T 29/481* (2015.01)

(58) Field of Classification Search

CPC .... A47C 7/22; A47C 7/40; B68G 5/00; Y10T 29/481

USPC ..... 297/284.2, 452.63

See application file for complete search history.

(56) References Cited

U.S. PATENT DOCUMENTS

| | | | | | |
|---|---|---|---|---|---|
| 2,182,253 | A * | 12/1939 | Farrell | A47C 7/425 | 297/230.11 |
| 3,258,259 | A * | 6/1966 | Bohlin | A47C 7/22 | 297/284.2 X |
| 4,309,058 | A * | 1/1982 | Barley | B60N 2/66 | 297/452.63 X |
| 4,462,635 | A * | 7/1984 | Lance | B60N 2/66 | 297/284.2 |
| 4,712,834 | A * | 12/1987 | Warrick | A47C 7/14 | 297/284.2 X |
| 4,858,992 | A * | 8/1989 | LaSota | B60N 2/002 | 297/284.2 |
| 5,058,952 | A * | 10/1991 | LaSota | A47C 23/24 | 297/284.2 |

(Continued)

*Primary Examiner* — Rodney B White

(74) *Attorney, Agent, or Firm* — Kilpatrick Townsend & Stockton LLP

(57) ABSTRACT

An adjustable seat back includes a frame having a perimeter and a cushioning material that is disposed at least partially within the frame's perimeter. The adjustable seat back also includes a tension member and a plurality of straps that are disposed over the frame with a distal end that is coupled with the cushioning material and a proximal end that is operationally coupled with the tension member. A reel based tightening mechanism is operably coupled with the tension member and configured to tension the tension member and thereby tension the plurality of straps. Tensioning of the plurality of straps effects adjustment of the cushioning material.

10 Claims, 5 Drawing Sheets

(56) References Cited

U.S. PATENT DOCUMENTS

| | | | | | |
|---|---|---|---|---|---|
| 5,403,067 | A * | 4/1995 | Rajaratnam | A47C 7/46 | 297/230.11 |
| 5,700,060 | A * | 12/1997 | Bullard | A47C 7/24 | 297/452.63 X |
| 5,867,852 | A * | 2/1999 | Knight | A47C 21/06 | 24/270 |
| 6,082,825 | A * | 7/2000 | Simon | A47C 7/35 | 297/452.63 X |
| 6,971,717 | B1 * | 12/2005 | Rhodes | A47C 7/46 | 297/452.63 X |
| 7,128,372 | B2 * | 10/2006 | Farquhar | B60N 2/66 | 297/284.2 X |
| 8,622,472 | B2 * | 1/2014 | Rajaratnam | A47C 1/022 | 297/284.2 |
| 2015/0076879 | A1 * | 3/2015 | Line | A47C 7/22 | 297/284.2 |
| 2015/0335502 | A1 * | 11/2015 | DuFresne | A61G 5/1056 | 297/284.2 |

* cited by examiner

CLOSURE DEVICES FOR SEAT CUSHIONS

CROSS-REFERENCES TO RELATED APPLICATIONS

This application claims priority to U.S. Patent Application No. 61/938,618 filed Feb. 11, 2014, and titled "Closure Devices for Seat Cushions," the entire disclosure of which is hereby incorporated by reference, for all purposes, as if fully set forth herein.

BACKGROUND OF THE INVENTION

The embodiments described herein are related to closure devices for adjusting seat backs or seat cushions. It may be desirable to adjust a seat back or seat cushion to provide more comfort and/or support to the back and spine. This may be especially desirable where an individual sits in a seat for an extended period of time. Non-adjustable seat back or seat cushions may become uncomfortable over time due to the creation of pressure points and the like, or due to the seat back or seat cushion not being properly fit or configured to the unique shape or contour of a user's back. An adjustable seat back or seat cushion may greatly reduce or relieve such discomfort, especially when the adjustment mechanism is convenient and easy to use. An especially advantageous use of an adjustable seat back or seat cushion may be in instances where an individual is confined to a wheel chair for an indefinite, prolonged, or permanent period of time.

BRIEF SUMMARY OF THE INVENTION

The embodiments described herein provide closure devices for seat backs or seat cushions. According to one aspect, an adjustable seat back or seat cushion includes a frame that defines a perimeter of the seat back or seat cushion and a cushioning material that is disposed at least partially within the perimeter of the frame. The adjustable seat back or seat cushion also includes a tension member and a plurality of straps that are disposed over the frame with a distal end that is coupled with the cushioning material and a proximal end that is operationally coupled with the tension member. A reel based tightening mechanism is operably coupled with the tension member and configured to tension the tension member and thereby tension the plurality of straps. Tensioning of the plurality of straps adjusts the cushioning material.

In some embodiments, the tension member, the plurality of straps, and the reel based tightening mechanism comprise a first tensioning system, and the adjustable seat back or seat cushion includes a second tensioning system having a similarly configured tension member, plurality of straps, and reel based tightening mechanism. In such embodiments, the first tensioning system may adjust a first zone or portion of the seat back or seat cushion and the second tensioning system may adjust a second zone or portion of the seat back or seat cushion.

In some embodiments, two of the plurality of straps may be coupled at one end to form a V-shaped strap. In some embodiments, at least some of the plurality of straps may extend across the seat back or seat cushion in a parallel configuration. In some embodiments, the tension member may be routed or directed across the seat back or seat cushion in a parallel configuration. Additionally or alternatively, the tension member may be routed or directed across the seat back or seat cushion in a crisscrossing configuration.

According to another aspect, a method of making an adjustable seat back or seat cushion includes providing a frame that defines a perimeter of the seat back or seat cushion and positioning a cushioning material at least partially within the perimeter of the frame. The method also includes coupling a distal end of each of a plurality of straps with the cushioning material, positioning a middle portions of each of the plurality of straps over the frame, and coupling a proximal end of each of the plurality of straps with a tension member. The method further includes coupling the tension member with a reel based tightening mechanism so that operation of the reel based tightening mechanism tensions the tension member and thereby tensions each of the plurality of straps. Tensioning of the plurality of straps may adjust the cushioning material.

BRIEF DESCRIPTION OF THE DRAWINGS

The present invention is described in conjunction with the appended figures:

FIGS. 9 and 10 illustrate perspective views of another seat back and closure system that is used to adjust the seat back.

Figure 1:
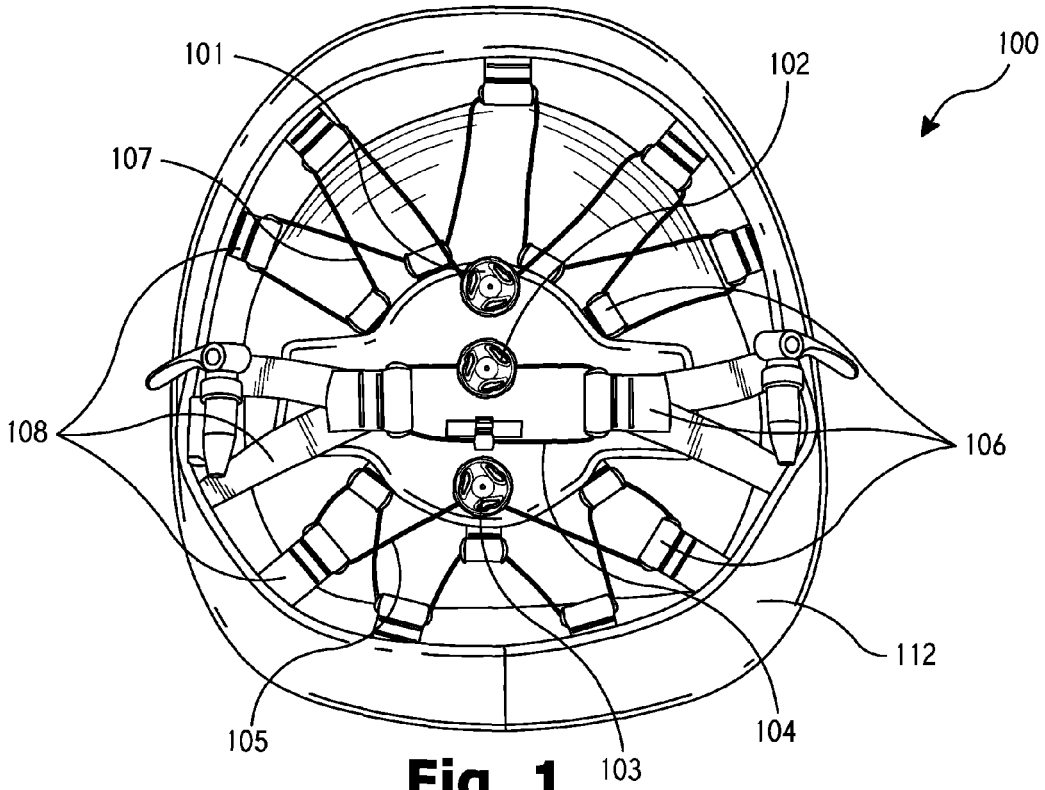
FIGS. 1-2 illustrate rear perspective views of a seat back and a closure system that is used to adjust the seat back.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

The embodiments described herein provide devices and mechanisms that are attachable to seat cushions to adjust the shape and/or feel of the seat cushion. For example, various straps of the seat cushion may be tightened or loosened to contour the shape of the seat cushion to match a user's back. The cushioning may also be tightened or loosened to adjust the comfort provided by the seat cushion. Conventional seat cushions often do include mechanisms that enable the shape and/or comfort of the seat cushion to be adjusted, or the seat cushions may include elementary straps, levers, or other mechanisms that may be difficult to use and/or provide little to no noticeable difference. For example, some seat cushions include multiple straps (e.g., five or more straps and in some instances 10 or more straps) that each need to be adjusted to adjust the seat cushion. Adjusting such seat cushions is often time consuming and/or inconvenient for the user.

The devices and mechanisms described herein are both easy to use and provide a noticeable difference in the seat cushion contour and/or support. The devices and mechanisms described herein may greatly reduce the number of straps or other components that need to be adjusted in adjusting a seat cushion. For example, the seat cushion or seat back may include one or more reel based devices that operate with multiple straps of the seat cushion to adjust the seat cushion. The seat cushion may also include one or more buckles or other release mechanisms. Exemplary embodiments of lacing systems are described in the following U.S. Patent Applications, the entire disclosures of which are incorporated by reference herein: U.S. patent application Ser. No. 13/343,658, filed Jan. 4, 2012, entitled "Reel Based Closure System," U.S. patent application Ser. No. 13/273,060, filed Oct. 13, 2011, entitled "Reel-Based Lacing System," and U.S. patent application Ser. No. 13/098,276, filed Apr. 29, 2011, entitled "Reel Based Lacing System." Other tightening devices, such as pull cords and the like may be used in addition to or in place of a reel based device.

In a specific embodiment, a seat cushion may include three reel based devices. Each of the reel based devices may control or tighten a different zone of the seat cushion. The seat cushion may include a center reel based device that pulls on or tensions a web guide that is attached to a strap of the seat cushion. The central reel based device and strap may be adjustable to provide lumbar support to the user's spine. The seat cushion may also include upper and lower zones that are controlled independently by two other reel based devices. A tension member or lace may route or extend from the reel and traverse through a series of web guides. The tension member or lace my pull on and tension one or more straps in the upper or lower zones. In some embodiments, the reel based device may be positioned on a panel. The panel may be created using a stiff, synthetic leather on top layer, a soft foam in the middle layer, and a soft synthetic leather base or bottom layer.

Figure 2:
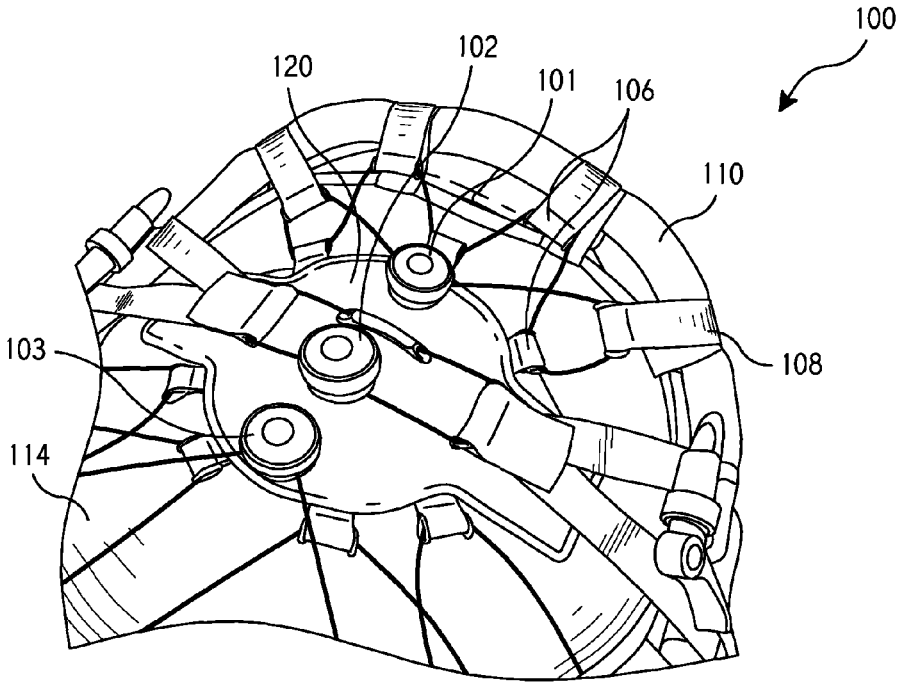

Referring now to FIGS. 1-8, illustrated is an embodiment of a seat cushion or seat back 100 (hereinafter seat back 100). FIGS. 1 and 2 illustrate perspective views of a rear portion of the seat back 100. Seat back 100 is defined by a frame 110 that and material layer 112 that is positionable over the frame. A front portion of the frame typically includes cushioning 114, such as a foam or other material layer(s). A distal end of a plurality of straps 108 are coupled with the cushioning 114, typically with an outer perimeter or edge of the cushioning 114. The cushioning is typically stretchable or flexible to a degree so that tensioning of the straps 108 adjusts the shape and/or firmness of the cushioning. A main body of the straps is wrapped or looped over the frame 110 and a proximal end of the straps 108 are coupled with or included a loop or guide 106 (hereinafter guide 106). A tension member or lace (hereinafter lace) is insertable through the loop or guide 106. The guides 106 function to route or direct the lace about a path about the seat back 100. As the lace is tensioned via a tightening mechanism, the lace pulls on or tensions a respective guide 106, which in turn tensions a respective strap 108 and a portion of the cushioning 114. With the straps 108 positioned or looped over the frame 110, the frame 110 functions as a pulley when the straps 108 are tensioned. Tensioning of the straps 108 pulls the cushioning 114 radially outward and toward the frame 110.

FIGS. 1 and 2 illustrate the seat back 100 including a three reel system configuration. The reel systems are configured to tension the lace as described in the patent applications incorporated herein. Specifically, the seat back 100 includes a first reel system 101 that is configured to tension a first lace 107 that is routed or directed along a top portion of the seat back 100 via a first series or set of straps 108 and guides 106. A second reel system 102 is configured to tension a second lace 104 that is routed or directed along a mid-portion of the seat back 100 via a second series or set of straps 108 and guides 106. A third reel system 103 is configured to tension a third lace 105 that is routed or directed along a lower portion of the seat back 100 via a third series or set of straps 108 and guides 106. Tensioning of the first lace 107 via the first reel system 101 causes the upper portion of the seat back's cushioning 114 to be adjusted. Similarly, tensioning of the second lace 104 via the second reel system 102 causes the mid-portion of the seat back's cushioning 114 to be adjusted while tensioning of the third lace 105 via the third reel system 102 causes the lower portion of the seat back's cushioning 114 to be adjusted.

In this manner, different zones of the seat back—i.e., the upper portion, the mid-portion, and the lower portion—are independently adjustable via three reel based mechanisms. Each reel system (101, 102, and 103) is able to tensions multiple straps 108 and guides 106 unlike conventional systems where each strap needs to be individually tensioned. As such, adjusting the contour, shape, or cushioning of the seat back 100 is greatly simplified in comparison with conventional systems.

In some embodiments, one or more straps 108 may be coupled or joined at the proximal end and/or share a common guide 106, so that essentially a single strap having a V-shaped pattern is formed. For example, the straps 108 that are tensionable via the mid-positioned reel system 102 are joined at the proximal end and share a common guide 106 to form a V-shaped pattern. In some embodiments, one or more of the reel systems may be attached to a panel material. For example, FIGS. 1 and 2 illustrate the first reel system 101, second reel system 102, and third reel system 103 positioned atop and attached to a panel 120. The panel forms a backing for each of the reel systems. The panel 120 may be created using a stiff, synthetic leather on top layer, a soft foam in the middle layer, and a soft synthetic leather base or bottom layer. The panel 120 may be free floating on the rear surface of the seat back 100, or may be attached to the frame 110 or other portion of the seat back 100.

Figure 3:
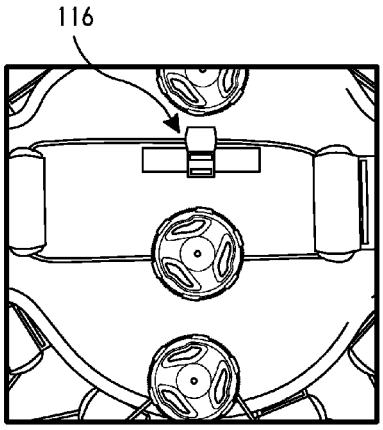
FIGS. 3-5 illustrate various detailed views of components of the closure system of FIGS. 1 and 2.
Figure 4:
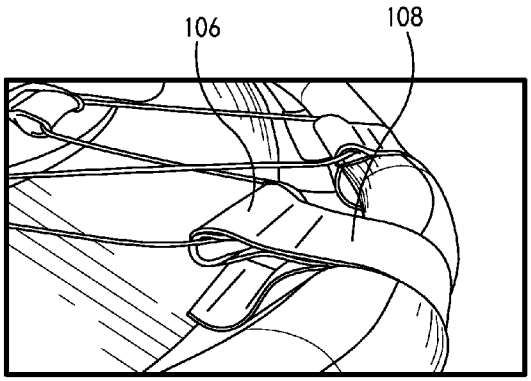

Referring now to FIG. 3-6, illustrated are enlarged views of various portions of the seat back 100. FIG. 3 illustrates that the seat back 100 (e.g., the panel 120) may include additional guides 116 that are not attached to the straps 108 and that route or guide the lace along the lace path. The additional guides 116 may be made of a fabric material or a more rigid material, such as various plastics. FIG. 4 illustrates a strap 108 and guide 106 in greater detail. As shown in FIG. 4, in some embodiments, the guides 106 may be formed via a combination of a relatively rigid material (e.g., plastic material) that is wrapped or looped in the loop formed in the proximal end of the straps 108.

Figure 5:
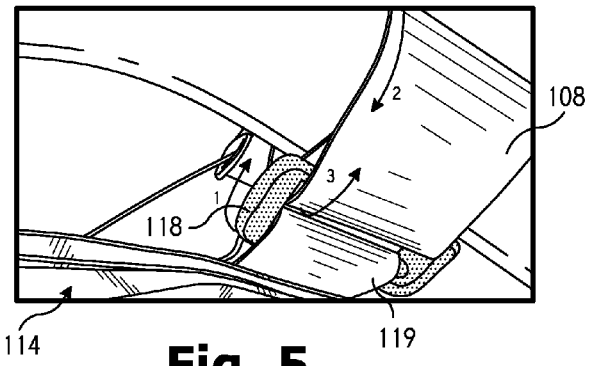
Figure 6:
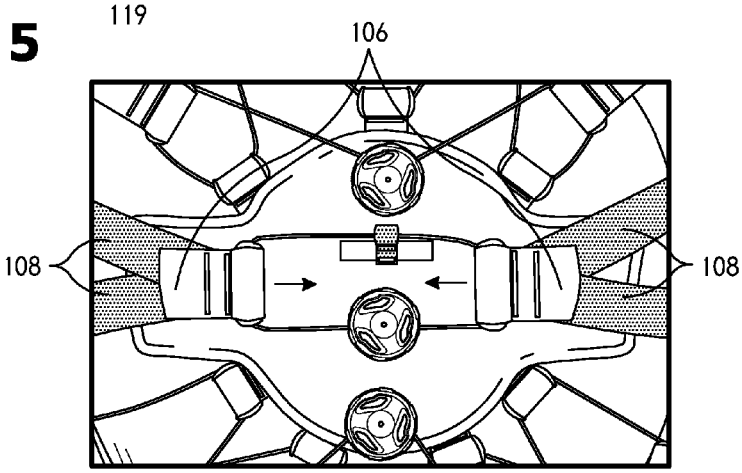
FIG. 6 illustrates a reel system of the closure system of FIGS. 1 and 2 being operated to adjust a portion of the seat back.

FIG. 5 illustrates the coupling of the distal end of a strap 108 with the cushioning 114 via a D-ring 118. Specifically, a small strap 119 that is attached directly to the cushioning 114 is positioned in one end of the D-ring 118. The strap 108 that is tensionable via the reel system is looped around the frame 110 (indicated by numeral 1), positioned through the D-ring 118 (numeral 2), and traversed or looped back over the outside of the frame 110 (numeral 3). In this manner, the frame 110 and D-ring 118 function as pulleys during tensioning of the strap 108 and cushioning 114. FIG. 6 illustrates adjustment of the mid-portion of the seat back 100. Specifically, as the middle reel system 102 is operated to tension lace 104, the guides 106 are pulled inward toward one another, which tensions the V-shaped straps 108 and in turns tensions and adjusts the mid-portion of the cushioning.

Figure 7:
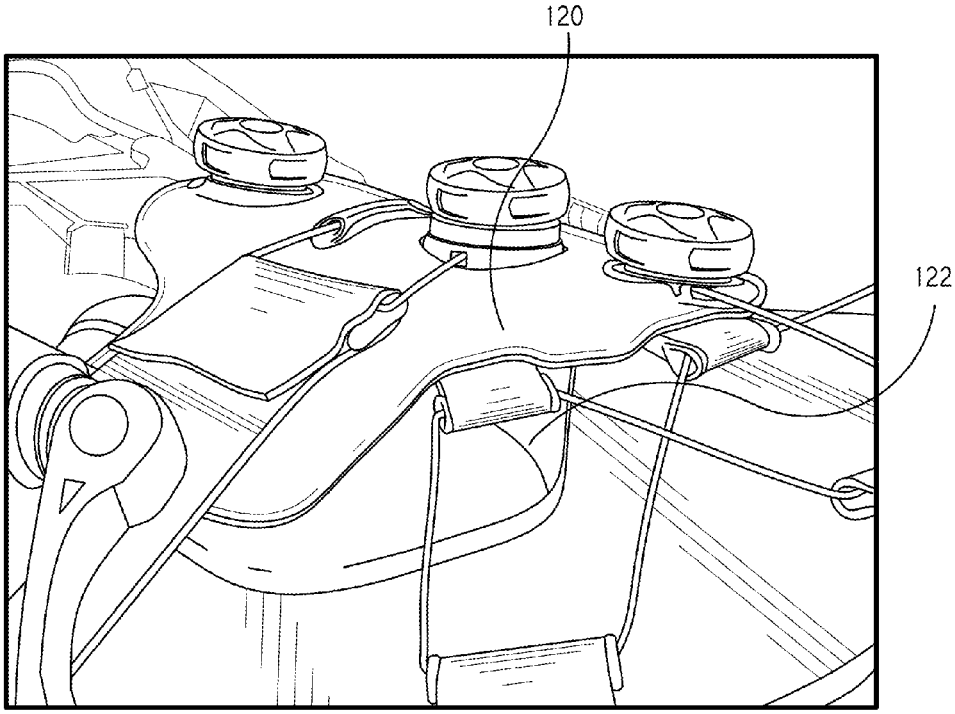
FIGS. 7-9 illustrate a cushion or padding member that may be used with the seat back of FIGS. 1 and 2.
Figure 8:
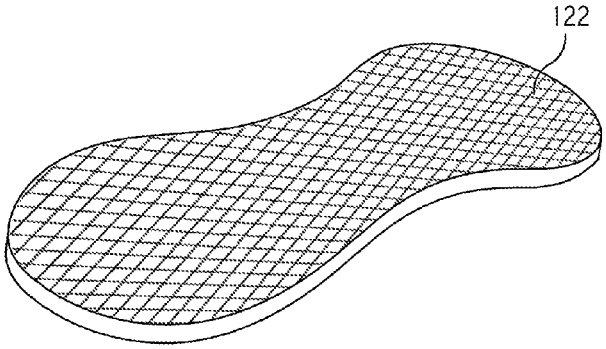

Referring now to FIGS. 7 and 8, in some embodiments a cushion member 122 may be positioned under the panel 120. The cushion member 122 may be lumbar padding. In some embodiments, the lumber padding 122 may be attached by a strip of webbing material (not shown) to an edge of the panel 120. In other embodiments, the padding or member 122 may be integrally formed with the panel 120. FIG. 8 illustrates an embodiment of the padding 122. In some embodiments, the straps 108 may be made of a fabric or webbing material, such as various polyesters. The cushioning 114 may be a fabric net that encases the foam or other cushion material. The material layer 112 may be a synthetic leather or other material. The frame 110 may be a metal material or other rigid structure. In some embodiments, each of the reel systems (i.e., 101, 102, and 103) may be the same reel systems. In other embodiments, one or more of the reel systems may be different so as to provide different tensioning power, lace take up, or other functionality.

Figure 9:
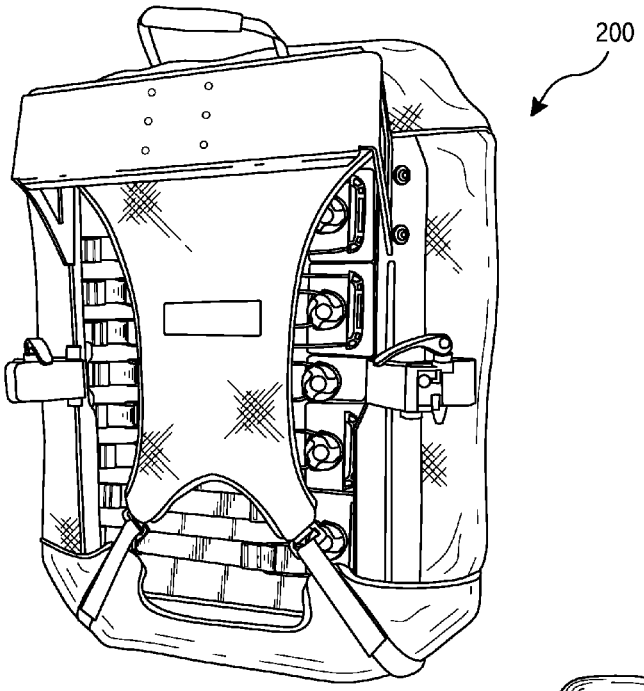
Figure 10:
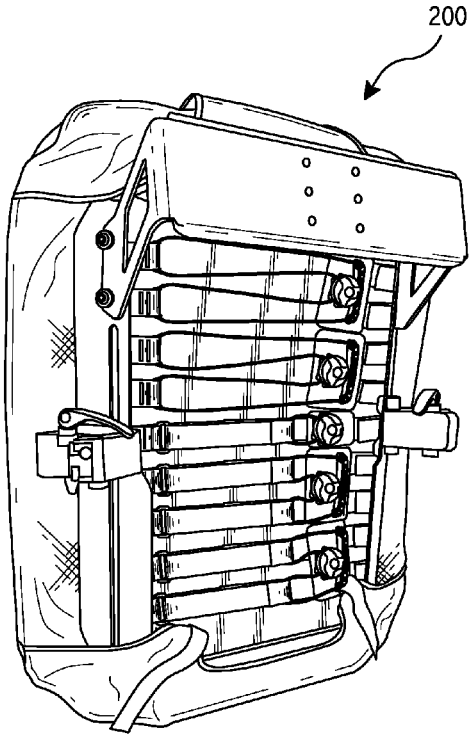

Referring now to FIGS. 9-13 illustrated is another embodiment of a seat back 200. Seat back 200 uses a reel system to replace conventional hook and loop straps (e.g., Velcro® straps). Seat back 200 is able to create a more micro-adjustable system and a better user interface for more effective positioning of the patient/user. This more effective positioning is achieved in part due to the zonal closure that is provided by the seat back 200. Zonal closure is important as the seat back 200 is adjusted to enable the seat to fit the patient or user's back or unique profile. Seat back 200 may be especially useful for back that are significantly deformed. FIGS. 9 and 10 illustrate perspective view of the seat back 200. As illustrated, seat back 200 includes five separate or independent closure zones for that provide a unique and customizable fit.

Figure 11:
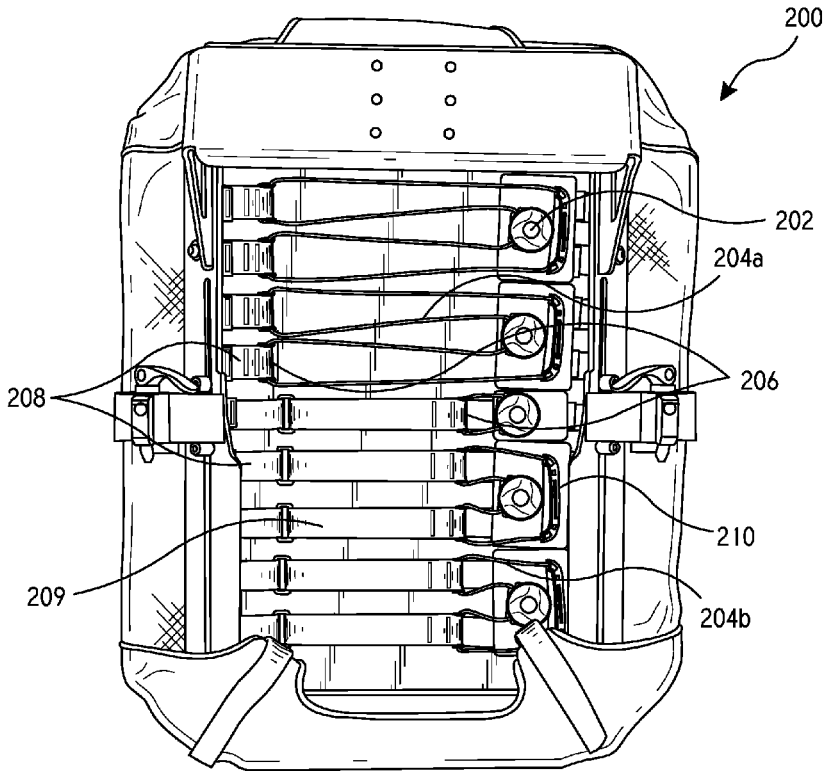
FIG. 11 illustrates a rear view of the seat back of FIGS. 9 and 10.

As illustrated in FIG. 11, the seat back 200 includes multiple reel systems 202 that are each configured to tension a lace (e.g., 204*a* or 204*b*) that are operationally coupled with the reel systems 202. Seat back 200 specifically includes five reel systems 202, although more or fewer reel systems may be employed as desired. Each lace (e.g., 204*a* or 204*b*) is positioned laterally across the back of the seat back and disposed through fabric loops or guides 206 that function to route or direct the lace (e.g., 204*a* or 204*b*) along a path of the seat back. Each guide 206 is in turn coupled with an end of a strap 208. An opposite end of each strap 208 is attached so the seat back's material so that tensioning of the strap 208 adjusts the shape, contour, softness, or other aspects of the seat back.

As illustrated, in some embodiments the lace (e.g., 204*a* or 204*b*) may be operationally attached to multiple straps 208 so that tensioning of the lace (e.g., 204*a* or 204*b*) tensions multiple straps. The lace (e.g., 204*a* or 204*b*) may likewise be routed or disposed through an additional elongate guide 210 that is positioned on the seat back 200 near the reel system 202. The elongate guide 210 may be positioned behind the reel system 202 and may have a greater width than the reel system 202 so that the lace (e.g., 204*a* or 204*b*) is routed behind the reel system 202. One or more portions of the elongate guide 210 may be open to allow dirt and other debris to escape from a lumen of the guides 210. In some embodiments, the reel system 202 and elongate guide 210 may be positioned on and attached to a common backing material—i.e., a panel as previously described. The lace (e.g., 204*a* or 204*b*) is routed about the path so that the lace (e.g., 204*a* or 204*b*) extends essentially parallel across the seat back 200.

Figure 12:
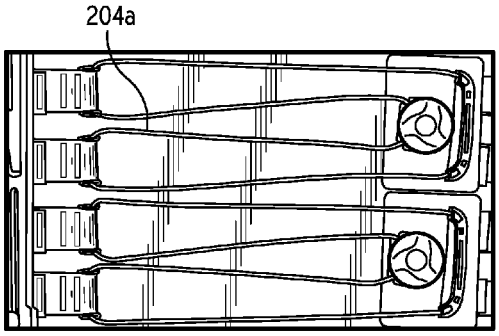
FIGS. 12-13 illustrate rear detailed views of components of the closure system of FIGS. 9 and 10.
Figure 13:
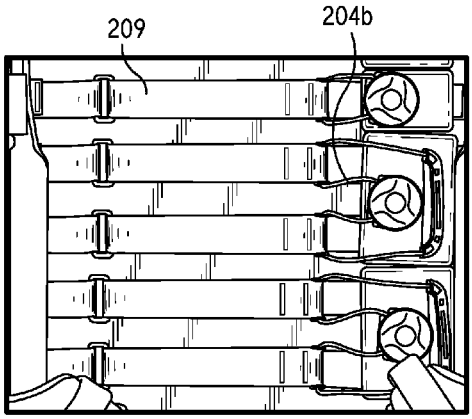

As further illustrated, in some instances the straps 208 may be coupled with an additional strap 209 that extends partially or fully across the seat back 200. In such instances, the additional strap 209 may be slidingly disposed through a D-ring that is attached to the strap 208 and the lace 204*b* may be attached to an opposite end of the additional strap 209 via a webbing/fabric loop or other guide. A proximal end of the additional strap 209 may be attached to the common back (e.g., panel) of the reel system 202 or to the seat back, while a distal end of the strap 209 is operationally coupled with the lace 204*b*. The path of the lace 204*b* may be relatively short in comparison with a lace 204*a* that extends essentially fully across the seat back 200 and couples directly with the strap 208. FIGS. 12 and 13 illustrate these different configurations in more detail. As shown in FIG. 11, the seat back 200 may include a combination of zones that include the longer lace 204*a* and that include the additional straps 209. For example, a top or upper portion of the seat back may 200 include lace 204*a* that extends essentially fully across the seat back 200 and a bottom or lower portion of the seat back 200 may include straps 209 that extend partially or fully across the seat back 200. Each reel system 202 of the lower portion may be operationally coupled with a single strap 209 or with multiple straps 209 as shown. In the illustrated configuration, the form of the patient may be held by the lace 204*a* in the upper portion of the seat back 200 while the form of the patient is held by the straps 209 in the lower portion of the seat back 200.

Having described the several embodiments, those skilled in the art will recognize that various other uses of the devices described herein are possible. Accordingly, the devices are not limited specifically to those embodiments described herein.

What is claimed is:

1. An adjustable seat back or seat cushion comprising:

a frame that defines a perimeter of the seat back or seat cushion;

a cushioning material disposed at least partially within the perimeter of the frame;

a tension member;

a plurality of straps that are disposed over the frame with a distal end that is coupled with the cushioning material and a proximal end that is operationally coupled with the tension member; and a reel based tightening mechanism that is operably coupled with the tension member and configured to tension the tension member and thereby tension the plurality of straps, wherein tensioning of the plurality of straps adjusts the cushioning material and wherein the tension member is routed or directed across the seat back or seat cushion in a crisscrossing configuration.

2. The adjustable seat back or seat cushion of claim 1, wherein the tension member, the plurality of straps, and the reel based tightening mechanism comprise a first tensioning system, and wherein the adjustable seat back or seat cushion further comprises a second tensioning system having a similarly configured tension member, plurality of straps, and reel based tightening mechanism.

3. The adjustable seat back or seat cushion of claim 2, wherein the first tensioning system adjusts a first zone or portion of the seat back or seat cushion and the second tensioning system adjusts a second zone or portion of the seat back or seat cushion.

4. The adjustable seat back or seat cushion of claim 1, wherein two of the plurality of straps are coupled at one end to form a V-shaped strap.

5. The adjustable seat back or seat cushion of claim 1, wherein at least some of the plurality of straps extend across the seat back or seat cushion in a parallel configuration.

6. A method of making an adjustable seat back or seat cushion comprising:

providing a frame that defines a perimeter of the seat back or seat cushion;

positioning a cushioning material at least partially within the perimeter of the frame;

coupling a distal end of each of a plurality of straps with the cushioning material;

positioning a middle portion of each of the plurality of straps over the frame;

coupling a proximal end of each of the plurality of straps with a tension member; and coupling the tension member with a reel based tightening mechanism so that operation of the reel based tightening mechanism tensions the tension member and thereby tensions each of the plurality of straps, wherein tensioning of the plurality of straps adjusts the cushioning material and wherein the tension member is routed or directed across the seat back or seat cushion in a crisscrossing configuration.

7. The method of claim 6, wherein the tension member, the plurality of straps, and the reel based tightening mechanism comprise a first tensioning system, and wherein the method further includes coupling a second tensioning system with the adjustable seat back or seat cushion, the second tensioning system having a similarly configured tension member, plurality of straps, and reel based tightening mechanism.

8. The method of claim 7, wherein the first tensioning system adjusts a first zone or portion of the seat back or seat cushion and the second tensioning system adjusts a second zone or portion of the seat back or seat cushion.

9. The method of claim 6, wherein two of the plurality of straps are coupled at one end to form a V-shaped strap.

10. The method of claim 6, wherein at least some of the plurality of straps extend across the seat back or seat cushion in a parallel configuration.

* * * * *